United States Patent [19]

Brito

[11] 4,113,156

[45] Sep. 12, 1978

[54] KEY RING HOLDER

[76] Inventor: Teodoro Guzman Brito, 5714 Rotterdam La., San Jose, Calif. 95118

[21] Appl. No.: 765,267

[22] Filed: Feb. 3, 1977

[51] Int. Cl.[2] ..... A45F 5/02

[52] U.S. Cl. ..... 224/5 R; 24/3 K; 24/237

[58] Field of Search ..... 224/5 R, 5 A, 25 R; 24/3 J, 3 K, 236, 237, 84 B

[56] References Cited

U.S. PATENT DOCUMENTS

| | | | |
|---|---|---|---|
| 845,743 | 3/1907 | Binder | 24/3 K X |
| 873,553 | 12/1907 | Johnson | 24/236 |
| 928,006 | 7/1909 | Thomas | 24/84 B X |
| 1,095,247 | 5/1914 | Toce | 24/3 K |
| 1,165,406 | 12/1915 | Hauer | 24/236 |
| 1,296,217 | 3/1919 | Reyburn et al. | 24/236 |
| 1,473,361 | 11/1923 | Tebbetts | 24/3 K X |
| 1,578,157 | 3/1926 | Miller | 224/5 A X |
| 1,700,132 | 1/1929 | Johnson | 24/3 K |
| 3,563,430 | 2/1971 | Forrest | 224/5 R |

*Primary Examiner*—Trygve M. Blix
*Assistant Examiner*—Winston H. Douglas
*Attorney, Agent, or Firm*—John J. Leavitt

[57] ABSTRACT

Presented is a key ring holder for suspending a key ring from the belt of the user. In one aspect, the key ring holder is constructed so that the belt must be laced through the key ring holder to preclude accidental loss of the key ring holder from the belt. In another aspect of the invention the key ring holder is constructed so that it may be slipped on and off of the belt of the user without removal of the belt.

3 Claims, 5 Drawing Figures

FIG. 1.
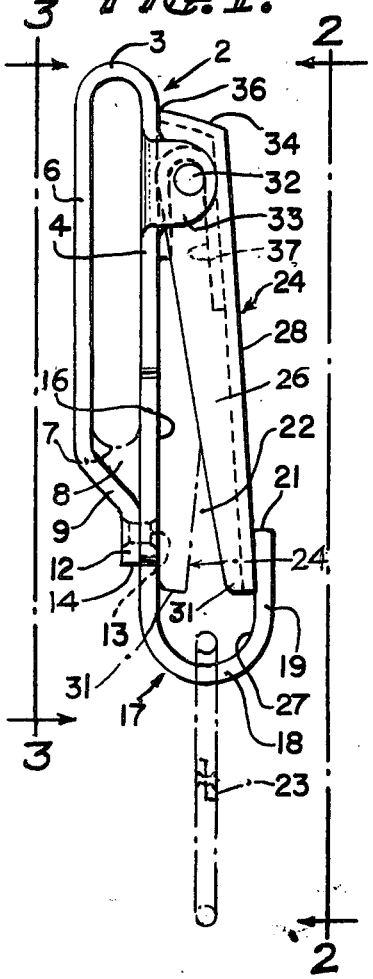
FIG. 2.
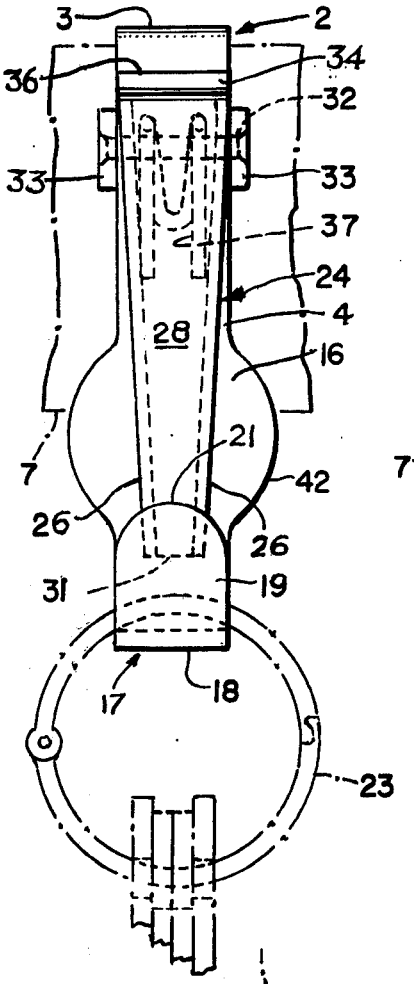
FIG. 3.
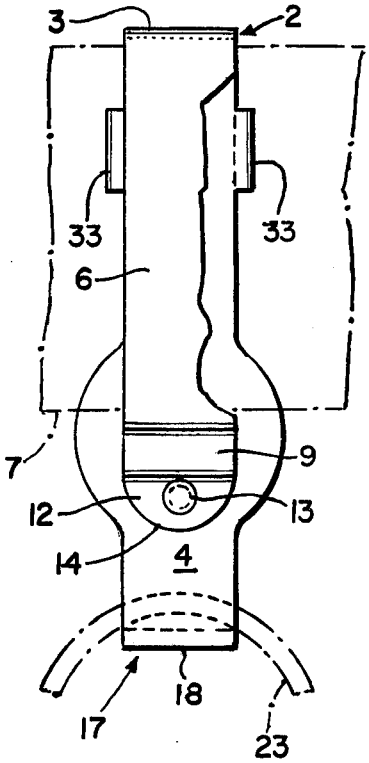
FIG. 4.
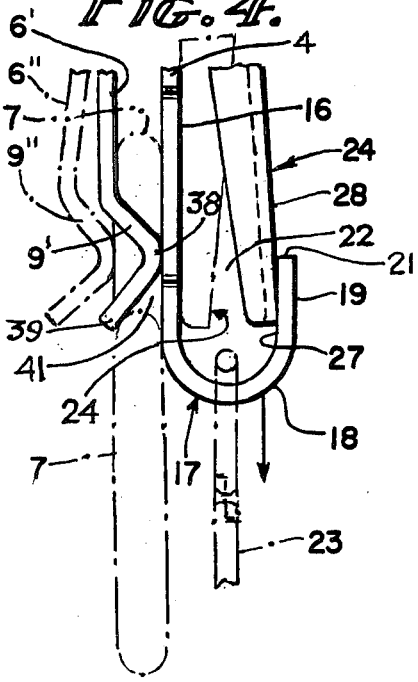
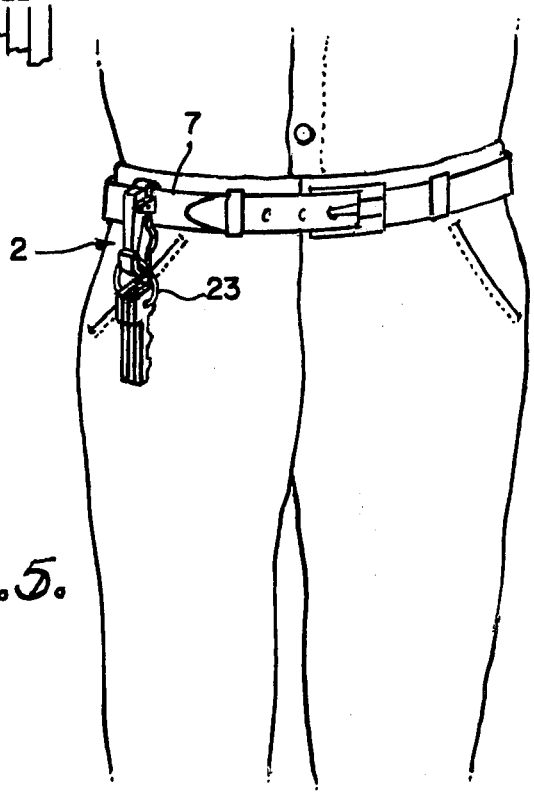
FIG. 5.

KEY RING HOLDER

BACKGROUND OF THE INVENTION

1. Field of the Invention

This invention relates to key ring holders, and particularly to the type that is suspended on the belt of the user and on which a key ring holding a multiplicity of keys may be readily engaged and disengaged.

2. Description of the Prior Art

Most of the prior art is believed to be found in Class 224, sub-classes 5R, 5A and 7; and Class 24, sub-classes 3 and 84. A search of the prior art has revealed U.S. Pat. Nos. 1,146,641; 1,609,347; 2,547,335; 3,357,615; and 3,970,227. Of these five (5) prior art patents, it appears that U.S. Pat. No. 3,357,615 is the most pertinent. That patent shows a length of steel which is doubled upon itself at about it's mid point to provide a V-shape structure one leg of which is adapted to slip behind a wearer's belt and to be retained thereon by a gripper tooth struck from the metal itself. The opposite leg has a Z-shaped end formed in it, the transverse portion extending toward the other leg and then merging with a straight portion substantially parallel to the other leg where it is formed with a hook on the end to receive a key ring. Fastened by a rivet to one leg of the V-shaped strip is a spring arm resiliently impinging against the inside of the hook to close the throat of the hook.

Because devices of this kind are worn close to the body, it is a disadvantage to provide sharp points and corners on the structure that might gouge into the person's body. Accordingly, one of the objects of the present invention is to provide a key ring holder that eliminates any such sharp points or corners.

It is important that key rings carrying various types of keys giving access to various types of property not be lost. Accordingly, the key ring holder should provide maximum security for such key rings. Therefore one of the objects of the present invention is to provide a key ring holder that must be mounted on a wearer's belt by threading the belt through the key ring holder so that it becomes necessary to remove at least a portion of the belt to remove the key ring holder.

In addition to security, another aspect of a key ring holder that must pass the test of buyer resistance is the aesthetic effect of the key ring holder. Accordingly, it is another object of the invention to provide a key ring holder fabricated from stainless steel, that may be polished to provide a beautiful luster which is only enhanced through continued wear of the key ring holder.

The invention possesses other objects and features of advantage, some of which, with the foregoing, will be apparent from the following description and the drawings. It is to be understood however, that the invention is not limited to the embodiment illustrated and described, since it may be embodied in various forms within the scope of the appended claims.

SUMMARY OF THE INVENTION

In terms of broad inclusion, the key ring holder of the invention comprises an elongated strip of stainless steel having one end portion thereof doubled back upon itself to provide an opening through which a wearer's belt may be threaded to securely suspend the key ring holder on the belt. The opposite end of the elongated strip is also bent back upon itself to provide a hook portion on which a key ring may be suspended. Pivotally mounted adjacent the mid portion of the strip is a resiliently biased gate member that extends across the throat of the hook to positively lock a key ring on the hook portion of the key ring holder.

BRIEF DESCRIPTION OF THE DRAWINGS

FIG. 1 is a side elevational view of the key ring holder, showing in broken lines a key ring suspended from the holder.

FIG. 2 is a front elevational view showing the key ring holder attached to a belt and supporting a key ring, the belt and key ring being shown in broken lines.

FIG. 3 is a rear elevational view.

FIG. 4 is a fragmentary side elevational view of a second embodiment of the key ring holder.

FIG. 5 is a fragmentary perspective view illustrating the manner of use of the key ring holder suspended in the belt of a wearer.

DESCRIPTION OF THE PREFERRED EMBODIMENTS

In terms of greater detail, the key ring holder of the invention is designated generally by the numeral 2, and is formed from an elongated strip of stainless steel bent at 3 to provide a main body portion 4 and a re-entrant portion 6 spaced from the main portion 4 an amount sufficient to receive the thickness of most belts. A belt 7 is shown engaged in the space 8 between the main body strip member 4 and the reentrant portion 6, the lower end of the re-entrant strip portion 6 being jogged inwardly in a portion 9 and merging with an end portion 12 that is permanently and rigidly secured to the lower end portion of the main body strip by an appropriate rivet 13 in one embodiment of the invention.

It should be noted that the end portion 12 is rounded as at 14 so as to eliminate any sharp edges or corners that might gouge into the wearer of the key ring holder. Additionally, it should be noted that the rivet 15 is flush with the outer surface of the end portion 12 and flush also with the inner surface 16 of the main body portion so as to eliminate any possibility of sharp edges or corners that might injure the wearer. At its lower end, the main body strip 4 is provided with a U-shaped section designated generally by the numeral 17 and including a bend portion 18 forming an integral continuation of the main body strip 4, and a re-entrant portion 19 terminating in a rounded end 21 that terminates approximately in a plane passing through the central axis of the rivet 13 to thus provide an opening, or throat 22 defined on the one hand by the reentrant portion 19 and on the other hand by the strip 4.

It is through this throat 22 that the key ring 23 must pass in order to be suspended on the hook portion 17 of the key ring holder. To insure that the key ring will be retained on the key ring holder, the throat 22 is adapted to be positively locked by a lever 24 having it's end portion 26 impinging against the inner surface 27 of the re-entrant portion 19 of the key ring holder, the lever 24 being formed in the form of a channel having a web 28 and integral side flanges 29, the lower end of the side flanges 29 being rounded as at 31 to eliminate any square corners that might be injurious to the wearer. At it's end remote from the hook portion 17, the lever 24 is pivoted on a pivot pin 32 the ends of which are riveted to upstanding lugs 33 formed integrally with the elongated main body strip portion 4 and which project away from the main body strip so as to provide operating clearance for the lever 24 pivoted thereon.

It should be noted that the lever 24 extends beyond the pivot 32 in an end portion 34, the end portion 34 constituting an extension of the web 28 that merges closely with the side flanges 29 so as to provide a box section that is completely enclosed and devoid of any sharp corners or edges that might be injurious to the wearer. Additionally, the end 36 of the end portion 34 rests lightly against the face 16 of the strip so as to eliminate any gaps in which articles of clothing might be snagged.

To cause resilient impingement of the lower end portion 26 of the lever 24 against the inner surface 27 of the hook section 17, there is provided a stiff hairpin type spring 37 trapped in the space between the main body portion 4 of the strip and the web 28, the spring being wrapped about the pivot 32 so that one arm thereof impinges resiliently against the face 16 of the main body portion 4 while the other arm thereof impinges against the web 28, thus resiliently biasing the arm 24 into a locking condition.

In use, all that is required is that pressure be applied against the lower end of the locking lever 24 with the key ring and a downward force exerted on the key ring to cause it to be engaged in the hook portion 17. Once engaged, it will be seen that the key ring is securely locked in place and cannot be disengaged accidentally.

It should be apparent that while the description and the drawings illustrate that the space 8 is sufficient to accommodate the popular wide belt worn today, the proportions of this space may be altered so as to securely accept more narrow, even wider, belts without departing from the invention.

In the embodiment of the invention illustrated in FIG. 4, the re-entrant portion 6' is provided with a similar jogged portion 9' but instead of the end portion 12 being riveted to the main body portion 4, it is bent as at 38 to provide an end portion 39 that is inclined away from the back side of the main body strip portion 4 to provide a bight 41 that functions as a cam so that the end portion 39 may be hooked over a belt and downward pressure applied on the key ring holder so that the belt works against the inclined surface of the end portion 39 and cams it outwardly into the position shown in broken lines, to permit access of the belt into the space 8. In like manner, to remove the key ring holder from the belt, all that is required is that it be pressed upwardly so that the belt edge cams against the jogged portion 9', again biasing the re-entrant portion 6' outwardly and permitting release of the key ring holder from the belt.

Because most key ring holders are fabricated from elongated metal strip material, there may be a tendency during use of the key ring holder for the key ring holder to literally twist about a vertical axis. To obviate this possibility, the key ring holder of the invention is provided with a relatively large flat area 42 integral with the main body portion 4, which provides sufficient width to preclude such twisting action of the key ring holder.

Having thus described the invention, what is sought to be protected by letters patent of The United States is as follows:

I claim:

1. A key ring holder comprising an elongated metal strip having:

a main body portion forming an integral part of said strip;

a belt-engaging re-entrant portion having a U-shaped upper end smoothly joining and forming an integral extension of the upper end of said main body portion, said re-entrant portion extending downwardly from said U-shaped upper end in spaced parallel alignment with a first surface of said main body portion and extending along a major portion of the length thereof, the lower, free end portion of said re-entrant portion being jogged inwardly so as to engage said main body portion at a point adjacent the lower end thereof;

a second, U-shaped, key-supporting re-entrant portion at the lower end of, and constituting an integral extension of, said main body portion, said second re-entrant portion having a bend portion smoothly joining said main body portion to a free leg portion extending upwardly, said free leg portion being substantially parallel to a second surface of said main body portion, in spaced alignment therewith, and terminating in a plane substantially including the point of engagement of said first mentioned re-entrant portion with said main body portion, said second re-entrant portion forming a relatively shallow hook within which may be supported a key ring, the U shape of said shallow hook defining an opening between said leg portion and said main body portion through which a key ring must pass in order to be suspended in said hook;

an enlarged flat section integral with and coplanar with said main body portion, located intermediate the upper and lower ends of said main body portion, and extending from opposite edges thereof to provide sufficient width to prevent twisting of said key ring holder on the belt of a wearer;

a pair of lugs integral with and perpendicular to the plane of said second surface of said main body portion of said strip projecting from opposite edges thereof, said second pair of lugs being parallel to each other and located adjacent the upper end of said main body portion;

a locking lever in the form of a channel having a web, integral, parallel flanges extending the full length of the web to form a rigid beam, and an end flange to close one end of said channel;

mounting means adjacent the closed end of said channel pivotally mounting said locking lever on said pair of lugs, the open side of said channel facing said main body portion with the free end of the locking lever extending into the opening of said hook for resilient impingement against the free leg portion of said hook; and spring means interposed between said main body portion and said locking lever and disposed between said pair of lugs to resiliently bias the free end of said locking lever away from said main body portion toward engagement with said free leg portion of said hook to maintain said opening in a locked condition to preclude the inadvertent release therefrom of a key ring held therein.

2. The combination according to claim 1, in which the free end of said re-entrant belt-engaging strip portion engaging the main body portion is riveted thereto.

3. The combination according to claim 1, in which the free end of said re-entrant belt engaging strip portion engaging said main body portion is bent outwardly to provide a bight between said free end portion and said main body portion whereby a belt pressed into the bight effects a camming action to resiliently bias the re-entrant strip portion outwardly to permit entry of the belt into the space between said main body portion and said belt engaging re-entrant portion.

* * * * *